US005224687A.

United States Patent [19]

Geckler, deceased et al.

[11] Patent Number: 5,224,687

[45] Date of Patent: Jul. 6, 1993

[54] FENCE POST EXTRACTOR

[76] Inventors: Duane K. Geckler, deceased, late of Carlsbad, N. Mex.; by Joana L. Geckler, legal representative, 1003 N. Thomas, Carlsbad, N. Mex. 88220

[21] Appl. No.: 929,477

[22] Filed: Aug. 17, 1992

Related U.S. Application Data

[63] Continuation of Ser. No. 788,245, Nov. 5, 1991, abandoned.

[51] Int. Cl.[5] ..... E21B 19/00

[52] U.S. Cl. ..... 254/30; 254/131; 254/133 R

[58] Field of Search ..... 254/29 R, 30, 131, 132, 254/133 R, DIG. 4; 81/124.3, 124.4

[56] References Cited

U.S. PATENT DOCUMENTS 1,202,551 10/1916 MacKenzie ..... 254/30
3,762,687 10/1973 De Rome et al. ..... 254/30
4,040,601 8/1977 Boardman ..... 254/133 R
4,236,427 12/1980 Becnel ..... 254/131
5,022,632 7/1991 Beideck ..... 254/132

FOREIGN PATENT DOCUMENTS 711586 10/1941 Fed. Rep. of Germany ..... 81/124.3

*Primary Examiner*—Bruce M. Kisliuk
*Assistant Examiner*—E. Morgan
*Attorney, Agent, or Firm*—Risto A. Rinne, Jr.; Douglas M. Clarkson

[57] ABSTRACT

A device for the extraction of fence posts having a T-shaped cross-section. The device is arranged to engage the fence post in a frictional binding action on the post when tilted by the upward application of force to one end of the device. The upward application of force is derived through cooperation with a jack, whereby the tilting of the device secures the device in position with the fence post and transfers the upward force from the jack through the device to the fence post. The tilting of the device also secures the jack to the device, thereby ensuring cooperation between the jack, the fence post, and the device throughout the full length of the lifting stroke.

1 Claim, 1 Drawing Sheet

FENCE POST EXTRACTOR

This is a continuation of Ser. No. 07/788,245 filed Nov. 5, 1991, now abandoned.

BACKGROUND OF THE INVENTION

1. Field of the Invention

The present invention, in general, relates to farm or ranch equipment and, more particularly, to devices used in cooperation with an auxiliary jack to extract posts, having a generally T-shaped cross-section, that are embedded in the ground.

Posts are in world wide use today primarily as support for fences, and although posts have other uses, it is most frequently their use in fences that involves a need for their removal. Wherever fence posts are used, it is at times necessary to remove them from the ground.

A device used to remove a fence post from the ground is identified, generally, as a "fence post extractor". While prior fence post extractors are considered to be useful, often they are inconvenient to use, expensive to manufacture, and in some instances even dangerous to the individual using them.

Accordingly, there exists today a need for a post extractor, primarily for fence posts, that is reliable, effective, simple to use and is safe in that it resists any tendency to slip, thereby resulting in injury.

2. Description of Prior Art

Post extractors, generally, are known. For example, U.S. Pat. No. 1,133,709 to Conley, that issued Mar. 30, 1915, describes an apparatus that could be useful for extracting drills that become embedded.

U.S. Pat. No. 1,999,174 to Jackson, that issued Apr. 30, 1935, describes a hoisting and lifting jack which is constructed for hoisting embedded rods and pipes, while permitting it to be utilized as an ordinary jack.

U.S. Pat. No. 2,777,726 to Lundgren et al., that issued Jan. 15, 1957, describes an adjustable fence post removing device that will fit posts of various thicknesses and of various shapes.

U.S. Pat. No. 3,103,343 to Benchley, that issued Sep. 10, 1963, describes a post dislodging and pulling implement that relies upon a wedge used with a hitching device for different types of post.

U.S. Pat. No. 3,620,503 to Bro, that issued Nov. 16, 1971, describes a fence stretcher for stretching fencing wire and serves as a fence post extractor.

U.S. Pat. No. 3,762,687 to De Rome et al., that issued Oct. 2, 1973, describes a fence post pulling apparatus that is constructed of a pair of apertured members connected together by a chain.

U.S. Pat. No. 4,040,601 to Boardman, that issued Aug. 9, 1991, describes a device for extracting fence posts having a T-shaped cross-section to engage lugs located on a post.

Swiss Patent No. 172281 to Conforti, that issued Dec. 18, 1933, describes a double hooked device for use with a jack to dislodge posts embedded in the ground.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a fence post extractor that is particularly well suited for extracting metal fence posts having a T-shaped cross section from the ground.

It is also an object of the invention to provide a fence post extractor that is useful in conjunction with a jack.

Another object of the invention is to provide a fence post extractor that is able to dislodge an embedded fence post by engaging any exposed location along the length of the fence post.

Still another object of the invention is to provide a fence post extractor that is easier and less costly to manufacture.

Yet another object of the invention is to provide a fence post extractor that secures a jack and, therefore, prevents the jack from slipping during usage.

A further important object of the invention is to provide a fence post extractor that is safe to use and will resist presently known tendencies to slip.

A still further important object of the invention is to provide a fence post extractor that is compatible for use with a variety of auxiliary jack.

Briefly a fence post extractor that is constructed in accordance with the principles of the present invention has a flat plate with two openings. A first of these openings provides clearance to allow the plate to pass over the fence post when placed in a substantially horizontal attitude and is generally triangular in configuration. A small arcuate recess is formed in one surface of the triangular opening for clearing the lugs found on some fence posts. A second of these two openings is formed to receive a jack for use with the fence post extractor and is generally rectangular in configuration. A small triangular recess is formed in one surface of this second opening to permit easier receipt of the lifting member of most utility jacks that are in common usage today.

DETAILED DESCRIPTION OF THE INVENTION

Figure 1:
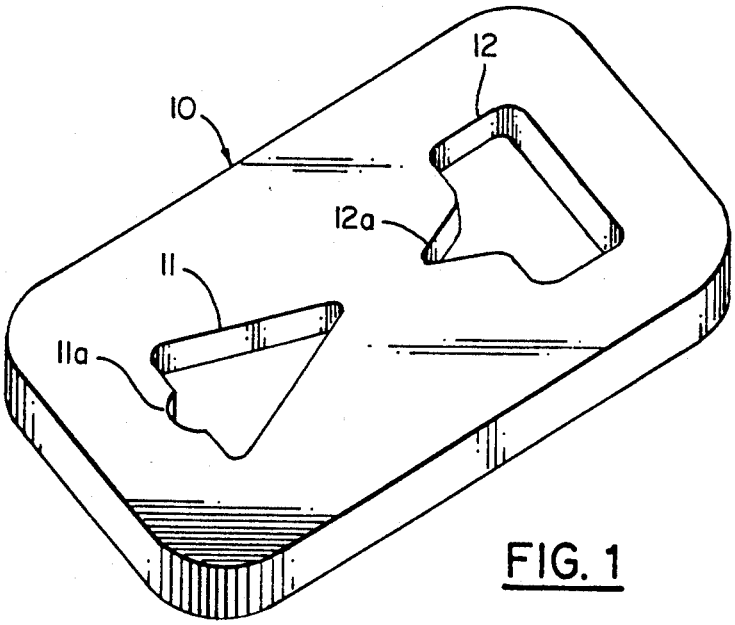
FIG. 1 is a view in perspective of a presently preferred form of fence post extractor.

Referring to FIG. 1, a generally flat plate 10 is shown with a first opening 11 and a second opening 12, and it is formed, preferably, of a mild steel alloy. Of course, it will be understood by one skilled in the art that the construction of the generally flat plate 10 is neither limited nor bound by metallurgy.

The use of plastics and other materials, such as a graphite fiber construction, are equally able to make use of the technology that characterizes the present invention. Similarly, details as to how either the fence post opening 11 or the jack opening 12 are formed in the flat plate 10 are deliberately omitted from this description to allow the appropriate selection of fabrication methodology that is most compatible with the materials being used.

For example, the fence post opening 11 or the jack opening 12 may be either punched, machined, cut, cast, eroded, or burned out of the plate 10 as is appropriate for the material of which the plate 10 is formed.

Figure 2:
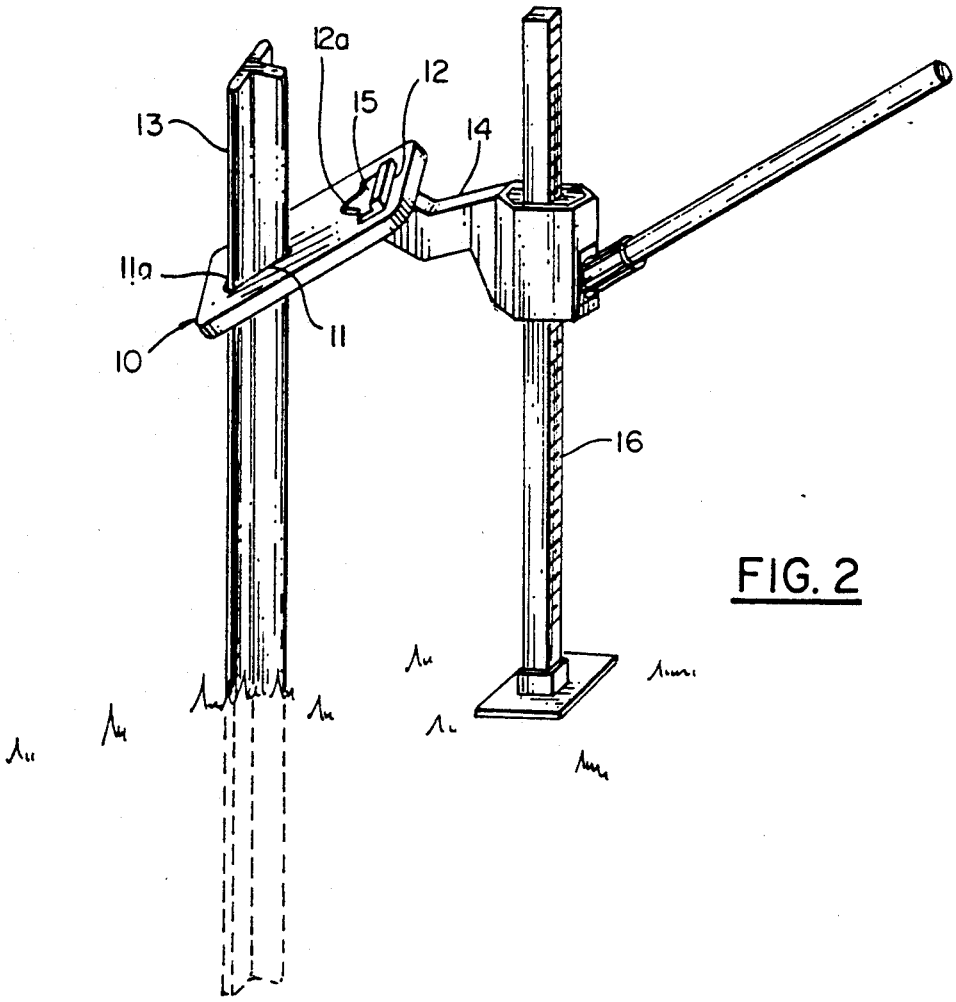
FIG. 2 is a view in perspective of the fence post extractor in operative cooperation with a jack to extract a post having a generally T-shaped cross section.

Referring next to FIG. 2, the generally flat plate 10 is held over the fence post 13 initially in a substantially horizontal attitude. This attitude provides ample clearance for the fence post 13 to pass through the opening 11 readily.

Next, the generally flat plate 10 is lowered over the fence post 13, as viewed in this figure, until it reaches the jack lifting member 14. The end 15 of the jack lifting member 14 is guided by the user so that it enters the jack opening 12.

Now, a relatively small force is applied by operating the jack 16 to raise the jack lifting member 14 and one end of the plate 10. As a result of this movement, the plate 10 tilts about the fence post 13 until the edges of the fence post opening 11 bear upon opposite sides of the fence post 13.

A continued urging of the generally flat plate 10 in this tilting direction effectively causes the plate 10 to bind with the fence post 13. As the upward force applied by the jack lifting member 14 to the end of the generally flat plate 10 is increased, this force now is transmitted directly to the fence post 13 to urge it upwardly from the ground.

In addition to binding the plate 10 with the fence post 13, the tilting action of the plate 10 accomplishes another purpose. The jack opening 12, in the preferred form of the invention, involves the substantially rectangular opening with a triangular recess 12*a* formed in the surface of the opening 12 furthermost from the jack 16.

The configuration of the jack opening 12, as described, will engage a variety of utility jacks 16 in use today. To accommodate a greater variety of utility jacks, modifications in the size, shape and contours of the jack opening 12, which provides the benefits hereinafter described, are anticipated as alternate embodiments of the same invention and hereafter shall become obvious to those skilled in this art.

As the flat plate 10 tilts about the fence post 13, it also rotates about the end 15 of the jack lifting extension 14. The rotation of the flat plate 10 about the end 15 of the jack 16 causes the triangular extension 12*a* of the jack opening 12 to rotate under and to capture the end 15 and a portion of the jack lifting extension 14 within the jack opening 12, thereby effectively securing the jack 16 in a position of cooperation within the flat plate 10.

Consequently the jack lifting extension 14 is prevented from dislodging from the flat plate 10 by any forward, rearward, sideways, or upwards motion of the jack lifting extension 14 with respect to the flat plate 10.

The tilting action of one end of the flat plate 10 simultaneously binds the generally flat plate 10 in position anywhere about the fence post 13, while it also secures the flat plate 10 in position about the end 15 and a portion of the jack lifting extension 14.

As a consequence of this securement, the jack 16 is neither able to be pulled towards nor is it able to slip in any direction away from the fence post 13, but rather the jack 16 remains in the same relative position with respect to the fence post 13 for the duration of the lifting cycle.

Consequently the entire application of upwards force as applied by the jack 16 to the plate 10 is available for urging the fence post 13 upwardly, rather than utilizing a portion of the upward force to alter the alignment geometry between the fence post 13 and the jack 16. This provides a more effective means for extracting a fence post 13.

It is noted also that when a jack 16 under considerable tension is freed suddenly from that tension, it may recoil violently and dangerously. As the present invention secures the jack 16 in a position of cooperation with the flat plate 10 for the duration of the entire fence post 13 lifting cycle, a safer means for extracting fence posts from the ground is provided.

The fence post opening 11 is substantially triangular in shape. A semicircular recess 11*a* is provided on the outermost surface of the fence post opening 11 for the sole purpose of clearing lugs that, sometimes, are to be found on some fence posts. Neither the semicircular (or arcuate) recess 11*a*, nor any other portion the the fence post opening 11, is to engage any such lugs during the application of lifting force upon the fence post 13. Therefore, the fence post opening 11 does not rely upon any means of engagement with the lugs in order to transmit the application of upwards lifting force to the fence post 13.

As a result of this configuration, the flat plate 10 will bind by friction against the fence post 13 at any location along the entire length of the post that is exposed above grade level. This benefit allows for the full range of lifting motion by the jack 16 to be utilized during the extraction process.

An additional benefit provided by the invention is that a fence post 13 may be extracted from the ground when obstructions limit the range of lifting motion by the jack 16. In these instances, the flat plate 10 is positioned in the lowest attainable place on a post and in contact with the end 15 of the jack lifting extension 14 without regard to the location of any fence post lug.

The jack lifting extension 14 is raised to the uppermost limit of the jack, thereby extracting the fence post 13 partially from the ground. The jack lifting extension 14 and flat plate 10 are lowered and the lifting process is repeated until the fence post 13 is dislodged and completely extracted from the ground.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A fence post extraction device for removing embedded fence posts, comprising:

a single plate of substantially rigid material of a predetermined size, thickness and outer configuration, said plate having parallel top and bottom flat surfaces, said plate further having first and second openings extending completely through said plate in a predetermined spaced relationship, said first and second openings each having a different distinct shape, said distinct shape of each opening being constant through an entire width of the plate from the top surface through to the bottom surface;

means for engaging a substantially triangular fence post, said engaging means being said first opening, said first opening being triangular with two adjacent sides longer than a third, shorter side, and a point of intersection of said two longer sides pointing toward said second opening;

means for connecting said extraction device to a fence post puller, said connecting means being said second opening, said second opening being rectangular in shape with two opposite long parallel sides and two opposite short parallel sides;

means for allowing clearance of fence post protrusions within said means for engaging; and means for securing said means for connecting to said fence post puller.

* * * * *